United States Patent [19]

Carlstedt

[11] Patent Number: 4,576,295

[45] Date of Patent: Mar. 18, 1986

[54] DRAFT GEAR FOR RAILROAD CAR COUPLER SYSTEM

[75] Inventor: Richard A. Carlstedt, Wheaton, Ill.

[73] Assignee: Miner Enterprises, Inc., Geneva, Ill.

[21] Appl. No.: 583,915

[22] Filed: Feb. 27, 1984

[51] Int. Cl.[4] ..... B61G 9/10

[52] U.S. Cl. ..... 213/32 R; 213/22; 213/37; 267/9 A

[58] Field of Search ..... 213/22, 24, 31, 32 R, 213/32 A, 32 B, 34, 37, 61; 267/9 R, 9 A; 308/DIG. 8, DIG. 9; 384/92, 93, 282–285, 276, 281

[56] References Cited

U.S. PATENT DOCUMENTS

| | | | |
|---|---|---|---|
| 948,316 | 2/1910 | Finning | 384/283 |
| 1,396,896 | 11/1921 | Symons | 213/31 |
| 1,426,022 | 8/1922 | Thomson | 92/155 |
| 1,914,479 | 6/1933 | Brooks | 267/9 A |
| 2,079,088 | 5/1937 | Spence | 267/9 A |
| 2,242,414 | 5/1941 | Blattner | 267/9 A |
| 2,558,117 | 6/1951 | Withall | 213/32 R |
| 3,348,633 | 10/1967 | Allan | 213/32 R |

*Primary Examiner*—Robert B. Reeves
*Assistant Examiner*—Dennis C. Rodgers

[57] ABSTRACT

A draft gear to absorb and cushion impacting forces on a railroad car coupler system includes a spring package in an inner section of a housing of the gear. The spring package connects with a set of friction shoes carried in friction shoe seats formed in an outer friction bore section of the housing. The shoes in turn engage with a wedge which extends from the housing outer end. In each friction shoe seat is a grooved recess having an inner, outer, and connecting groove portion arranged in an H-like shape. In each grooved recess in turn is a metallic insert to provide a film of lubricant between the shoes and friction shoe seats respectively. During operation the impacting forces on the coupler system drive the wedge and shoes inward to compress the spring package. This movement is restrained by friction between the shoes and friction shoe seats. Because the inserts are rigid, insert material in the outer groove portions is not readily dislodged, if the shoes move sufficiently inward to expose the outer groove portions. Thus, the coefficient of friction between the shoes and friction shoe seats remains properly regulated to insure continued effective frictional restraint. Additionally, the shoes are inhibited from being stuck when the draft gear is in a compressed state.

7 Claims, 12 Drawing Figures

DRAFT GEAR FOR RAILROAD CAR COUPLER SYSTEM

BACKGROUND OF THE INVENTION

1. Field of the Invention

This invention relates to railroad car coupler systems and more particularly to draft gears for such systems where inserts are used in the draft gear to regulate frictional restraint as the draft gear acts to absorb and cushion impacting forces on the coupler system.

2. Prior art

Modern railroad car coupler systems typically include a draft gear to absorb and cushion impacting forces on the system and thus prevent structural damage to the system as well as the railroad car.

An early draft gear for a railroad car coupler system is set forth in U.S. Pat. No. 1,982,575. The gear includes a front and a rear follower to interact with a shank and a yoke of the coupler system respectively. The front follower is positioned to force a casing of the gear rearward wherein the rear follower acts to move a set of wedges. Movement of the wedges is frictionally impeded by wear plates as well as compression of a spring set. The wedges are held apart by leaf springs to compressively engage the wear plates.

A more modern draft gear is disclosed in U.S. Pat. No. 3,348,633. This gear includes a wedge which moves inward in response to an external force applied to the coupler system. The wedge interacts with a set of friction shoes located in a complementary set of friction shoe seats. Inward movement of the wedge and shoes is resisted by compression of elastomeric pads and friction between the shoes and friction shoe seats. Each friction shoe seat has a pair of grooves to hold a metallic lubricant to regulate the coefficient of friction between the shoe and seat. The metallic lubricant is disposed in the grooves from an insert which is first placed between a respective shoe and seat. A heavy duty hammer drop is then applied to the gear wedge to press the insert material into the grooves as well as outwardly between the shoe and friction shoe seat surfaces.

SUMMARY OF THE INVENTION

This inventive draft gear for a railroad car coupler system includes a hollow cast housing. A spring package typically comprising a number of elastomeric pads is positioned in an inner section of the housing between an end wall and a follower. The follower extends into an outer friction bore section defining a set of friction shoe seats. In each friction seat is a friction shoe. The shoes engage with a wedge which extends outward from the friction bore section.

Each friction shoe seat has a grooved recess defined by a pair of inner and outer groove portions positioned transversely to a longitudinal axis of the housing and a connecting groove portion which may be positioned in alignment with such. In each grooved recess is a like-shaped rigid metallic insert having segments to provide a film of lubricant between the friction shoe and friction shoe seat.

During operation of the coupler system and included draft gear the system is subjected to impacting forces of considerable magnitude. These forces are transmitted to the draft gear which absorbs and cushions such to prevent structural damage to the system and connected railroad car body. These forces move the wedge inward which in turn pushes the friction shoes inward as well as radially outward. The inward movement is resisted by friction between the shoes and respective friction shoe seats and by compression of the spring package.

The draft gear of the invention provides several advantages over known draft gears.

First, frictional restraint to shoe movement in the friction shoe seats is more effectively regulated. Improved regulation increases life of the shoes as well as inhibiting shoe lockup. If shoe lockup occurs when the draft gear is in a compressed state, the shoes and spring package are prevented from returning to their preimpacted position to effectively protect the coupler system from structural damage caused by subsequent impacting forces. Improved regulation is achieved by inhibiting dislodgement of insert material in the housing groove recesses. In known draft gears such dislodgment can occur when the shoes are driven inward a sufficient amount to uncover the insert material in the outer groove portions. Because the inserts of this inventive draft gear are rigid while a remaining portion of these inserts continues to be covered by the shoes, insert material in the outer groove portions is not dislodged but stays in the outer groove portions. Thus, continued uniform operative shoe action is maintained.

A further important advantage of this new and useful draft gear is that the gear housing may be made using modern, high production foundry techniques. The hollow interior of the housing is formed by a core placed in a mold. The core in turn is made in a core box having portions joining to form a parting line. The parting line is positioned to align with one of the housing friction bore section grooved recess connecting groove portions. By providing an enlarged opening to the other connecting groove portions, the core box portions may be drawn away at a right angle from a completed core.

DESCRIPTION OF THE PREFERRED EMBODIMENT

Figure 4:
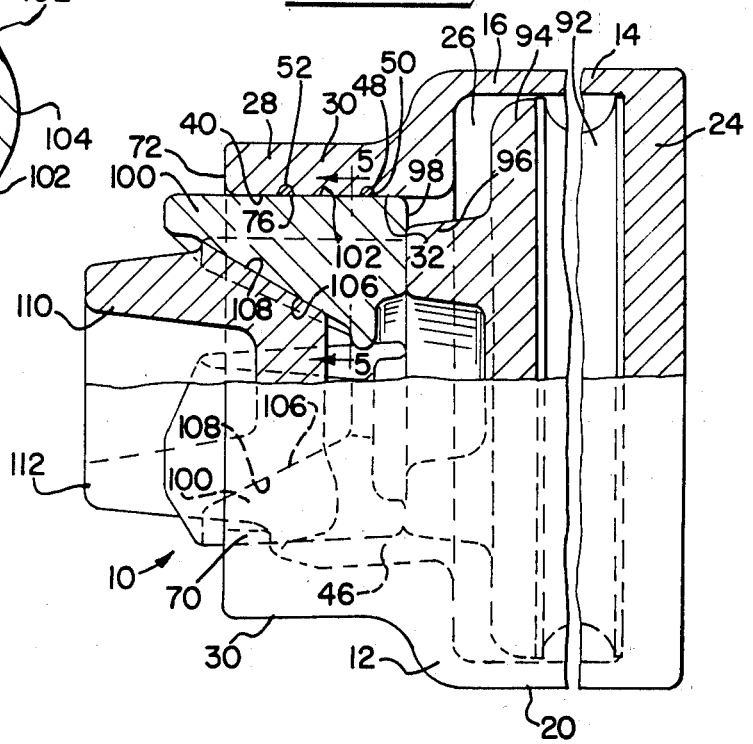
FIG. 4 is a side elevation view, partially in section, of an assembled draft gear of this invention.

An assembled draft gear for a railroad car coupler system is shown generally in FIG. 4 and designated 10. As is understood by those familiar with this art, the gear 10 is typically carried in a yoke (not shown) which in turn attaches to a sill (not shown) of a railroad car body (not shown).

Figure 1:
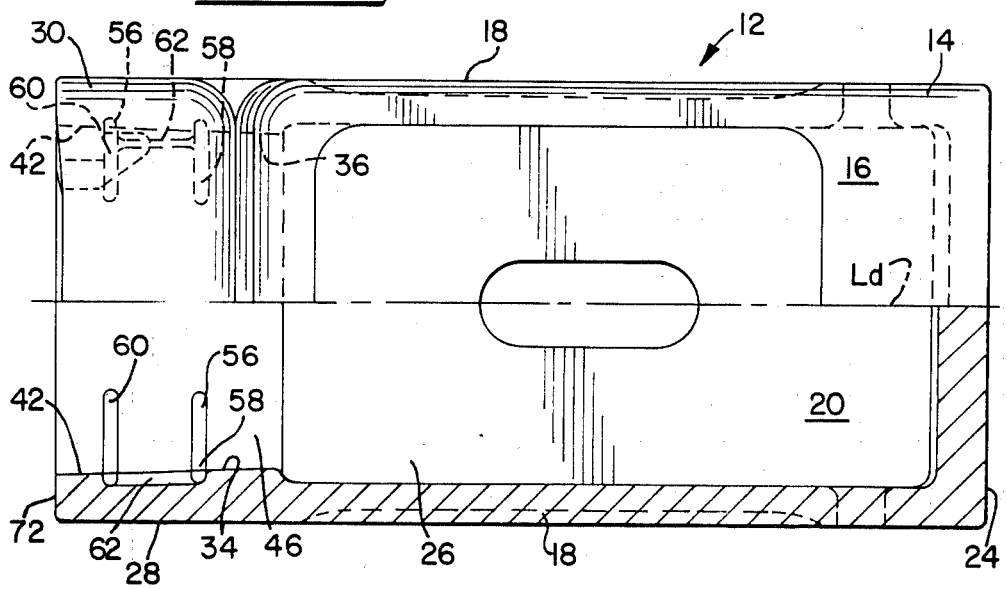
FIG. 1 is a plan view, partially in section, of a draft gear housing of this invention.
Figure 2:
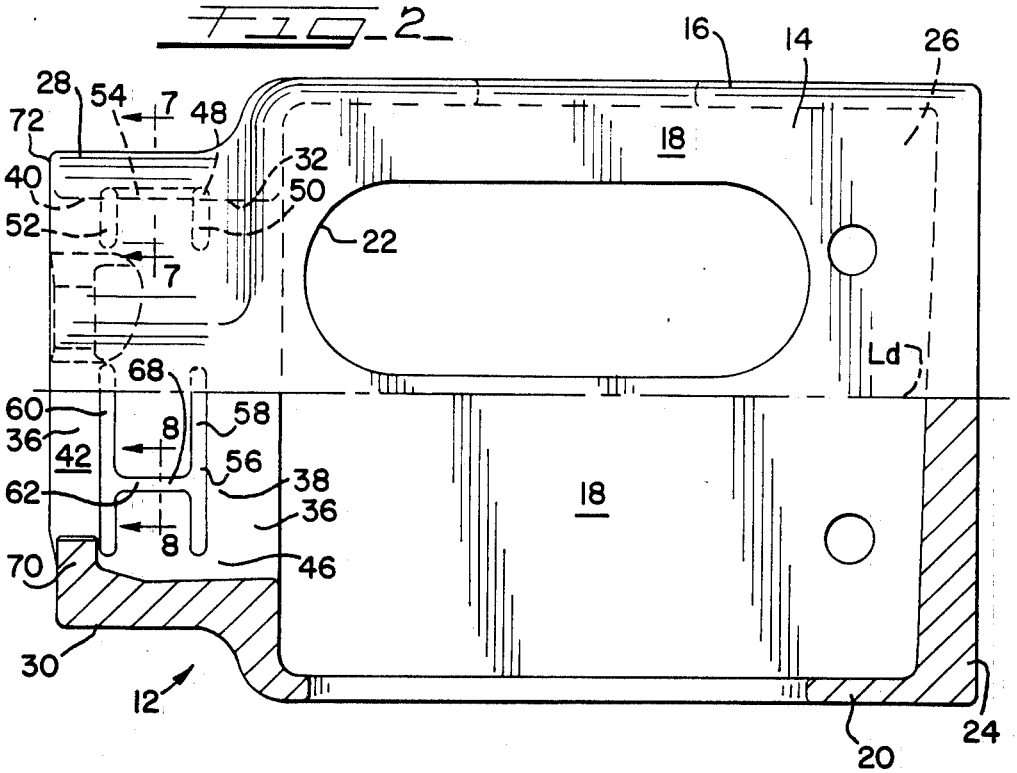
FIG. 2 is a side elevation view, also partially in section, of the housing of FIG. 1.
Figure 3:
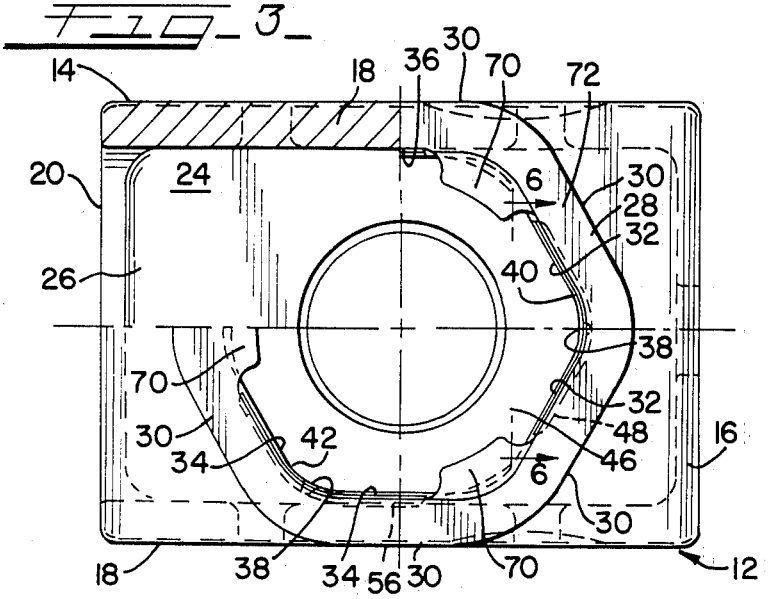
FIG. 3 is a front elevation view, with a cutaway portion in section, of the housing of FIG. 2. The housing is rotated 90 degrees clockwise to show it on its right side, as such positioned as actually used in the coupler.

A housing 12 of the draft gear 10 is shown in detail in FIGS. 1, 2 and 3. The housing 12 has an inner section 14 defined by a top wall 16, spaced apart sidewalls 18, and a bottom member 20. The housing 12 is cast and may include a number of weight reducing openings, for example an opening 22 in each sidewall 18. Such openings 22 also facilitate removal of the core of the housing 12 as cast. Additionally, the housing inner section 14 includes an inner end wall 24 to complete a closure to an inner space 26.

Connecting with the housing inner section 14 is an outer friction bore section 28. The friction bore section 28 is defined by sidewalls 30 set in a hexagon array. Pairs of adjacent sidewall inner surfaces 32, 34, and 36 join with a 120 degree radiused corner 38, see FIG. 3, to form a top friction shoe seat 40 and two side friction shoe seats 42. These seats 40, 42 define a friction bore section inner space 46.

Figure 6:
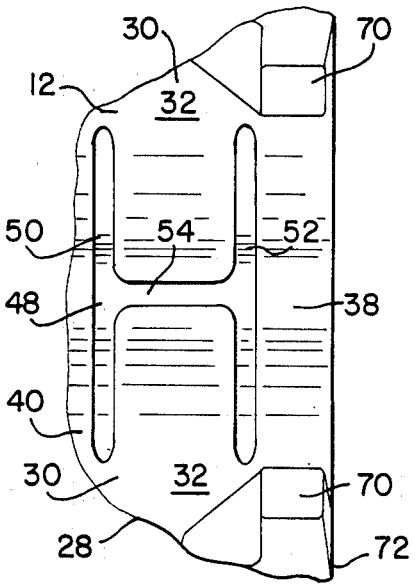
FIG. 6 is a detailed view of a portion of a friction bore section as seen generally along the line 6—6 of FIG. 3 showing a grooved recess therein.
Figure 7:
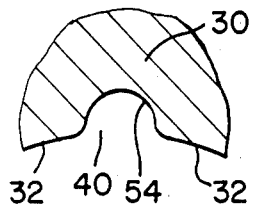
FIG. 7 is a detailed cross section view as seen generally along the line 7—7 in FIG. 2.

In the top friction shoe seat 40 is a top H-shaped grooved recess 48, see FIG. 6. The top grooved recess 48 is defined by an inner groove portion 50 and an outer groove portion 52 joined by a connecting groove portion 54. The cross sectional configuration of the top connecting groove portion 54 is shown in FIG. 7 with the configuration of the groove portions 50, 52 being substantially the same.

Figure 8:
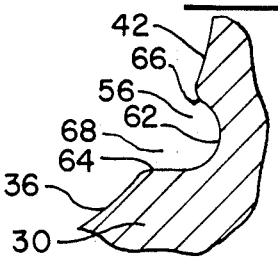
FIG. 8 is a detailed cross section view as seen generally along the line 8—8 in FIG. 2.
Figure 9:
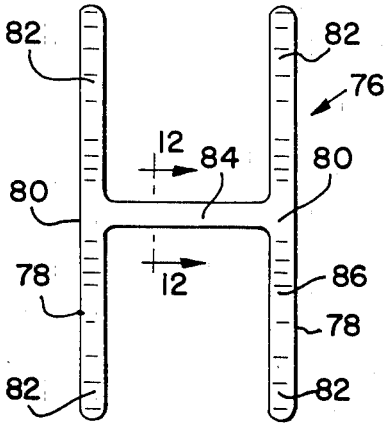
FIG. 9 is a front elevation view of a lubricating insert usable in the assembled draft gear of FIG. 4.
Figure 10:
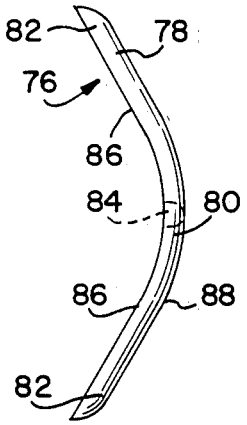
FIG. 10 is a side elevation view of the insert of FIG. 9.
Figure 11:
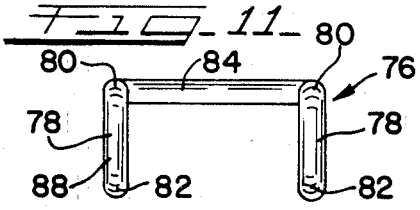
FIG. 11 is an end elevation view of the insert of FIG. 10.

In each side friction shoe seat 42 is a further H-shaped grooved recess 56, each likewise defined by an inner and outer grooved portion 58, 60 and a connecting groove portion 62. As seen in FIG. 8, a lower wall 64 of the connecting groove portion 62 is substantially horizontal while an upper wall 66 is positioned on an angle approximately 30 degrees above the horizontal. This positioning of the lower and upper walls 64, 66 forms an enlarged opening 68 to each connecting groove portion 62 of the side grooved recesses 56.

Note that the connecting groove portions 54, 62 are positioned to align with the corners 38. This alignment places the inner and outer groove portions 50, 52 and 58, 60 perpendicular to a longitudinal axis Ld of the housing 14 and the connecting groove portions 54, 62 parallel thereto. As so positioned, the grooved recesses 48, 56 are located between and inward from three spaced lugs 70 extending into the friction bore inner space 46 at a front wall 72 of such.

Figure 12:
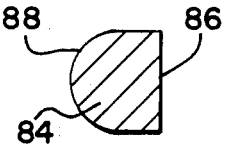
FIG. 12 is a cross section view as seen generally along the line 12—12 of FIG. 9.

In the top grooved recess 48 and the two side grooved recesses 56 are lubricating inserts 76 made of a bronze material. The insert 76 is shown in detail in FIGS. 9–12 and includes a pair of parallel positioned, crescent shaped segments 78. Each segment 78 has a middle radiused portion 80 joined by straight end portions 82. The segments 78 are joined at their approximate midpoint by a connecting segment 84. An inner surface 86 of the segments 78, 84 is substantially flat to align respectively with the inner surfaces 32, 34, and 36 and radiused corners 38 of the friction bore section sidewalls 30. An outer surface 88 of the insert segments 78, 84 is radiused to fit snugly in the top and side grooved recesses 48, 56. A cross section of the connecting segment 84 is shown in FIG. 12; segments 78 have a similar cross sectional configuration.

As was noted earlier, the assembled draft gear 10 is shown in FIG. 4 and includes a spring package comprising a number of elastomeric pads 92 located in the inner space 26 of the housing 12 between the end wall 24 and a movable intermediate follower 94. An outer end 96 of the follower 94 extends into the housing friction bore inner space 46 to engage an inner wall 98 of three friction shoes 100.

Figure 5:
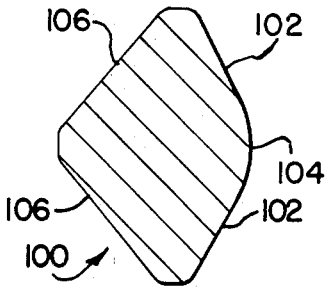
FIG. 5 is a cross section view of one of the friction shoes of the assembled draft gear as seen generally along the line 5—5, in FIG. 4.

Each friction shoe 100 has a pair of angularly positioned wear surfaces 102, best seen in FIG. 5. These wear surfaces 102 join a radiused end 104. One each of the friction shoes 100 is located in the top and side friction shoe seats 40, 42 such that the friction shoe wear surfaces 102 are in contact with the friction bore section sidewall inner surfaces 32, 34, and 36 respectively. This arrangement places the shoe wear surfaces 102 in contact with the flat inner surface 86 of the insert segments 78. The radiused ends 104 of the shoes 100 in turn are positioned in the corners 38 and thus prepared for contact with the connecting segments 84 of the inserts 76.

Each friction shoe 100 further has an inwardly sloped inside wall 106. These inside walls 106 of the friction shoes 100 in turn are in contact with complementarily formed sloped wedging surfaces 108 of a wedge 110. An outer end 112 of the wedge 110 extends outward from and beyond the front wall 72 of the housing friction bore section 28. The outer end 112 of the gear wedge 110 typically is in contact with a follower (not shown) of the coupler system. This follower engages an inner end of a shank having an outer coupler head end for joinder with the coupler head of a further railroad car.

As was briefly noted earlier, the draft gear housing 14 is made using casting techniques. A core having an exterior surface complementary to an interior surface of the housing 14 is placed in a mold having an interior surface complementary to an exterior surface of the housing 14. The housing core is made in a core box having an interior surface substantially the same as the interior surface of the housing 14. Thus, the core box also is formed with a top and side grooved recesses similar to the top and side grooved recesses 48, 56 of the housing 14. To utilize high production casting techniques a parting line between core box portions is aligned with the connecting groove portion of the top grooved recess of the core. After the core is formed, the enlarged openings to the connecting groove portions of the side grooved recesses as provided by the angularity between the lower and upper walls of such allow the core box portions to simply be drawn away at approximately a right angle from the formed core.

During operation the coupler system is subjected to impacting forces. These forces may be in an inward direction, i.e., buff or in an outward direction, i.e., draft. The coupler system is subjected to buffing forces when coupling of two railroad cars occurs, for example the coupler heads of each collide at a speed in excess of 5 m.p.h. The coupler system is placed in draft when the railroad car is drawn forward from a standing position, for example.

To prevent these impacting forces from causing structural damage to the coupler system or other portion of the railroad car, the draft gear 10 acts to absorb and cushion the shock of these forces. For example, when a buffing force is applied, the wedge 110 of the draft gear 10 is driven inward. The sloped surfaces 108 of the wedge 110 in turn force the friction shoes 100 inward as well as radially outward. The radial outward movement is limited by contact between the friction shoes wear surfaces 102 and the sidewalls 30 of the friction bore friction shoe seats 40, 42. The inward movement of the friction shoes 100 is first restrained by friction between the friction shoe wear surfaces 102 and the friction shoe seats 40, 42. The magnitude of this restraining force is equal to the product of the coefficient of friction between these surfaces and the amount of force placed on the friction shoes 100 by the wedge 110 in a direction normal to the direction of shoe movement. Additionally, inward shoe movement is resisted by the elastomeric pads 92 of the spring package which are compressed as the shoes 100 move the intermediate follower 94 toward the housing end wall 24.

Note that the friction shoes 100 can move inward a distance sufficient to expose the insert segments 78 in the outer groove portions 52, 60. A portion of the insert connecting segments 84 and other parallel segments 78 in the inner groove portions 50, 58 remain in contact with the shoes 100. The rigidity of the inserts 76 insures that the exposed segments 78 remain in their respective outer groove portions 52, 60.

During this shoe movement the shoe wear surfaces 102 also interact with the flat inner surfaces 86 of the inserts 76. A film of insert material wipes on to the shoe wear surfaces 102 to provide a lubricating interface between the shoes 100 and the friction shoe seats 40, 42. This lubricant regulates the coefficient of friction to maintain such at a near uniform level thereby increasing the useful life of the shoes 100 as well promoting uniform operative shoe action. The shoes 100 not only move inward against a uniform frictional restraint, but they may then also move outward to return the wedge 110 to engage the lugs 70 once the impacting force has been absorbed. If the elastomeric pads 92, shoes 100 and wedge 110 did not so return, the draft gear 10 may not effectively absorb a subsequent impacting force. Structural damage to the coupler system could then occur.

As the wear surfaces 102 of the friction shoes 100 are depleted, the shoes 100 move radially outward. This outward shoe movement presses the shoe radiused ends 104 into a tighter fit with the friction shoe seat radiused corners 38 respectively. As the tightness of this fit increase, the probability of shoe lockup also increases. Note, however, that the shoe radiused end 104 comes into contact with the insert connecting segment 84. The insert connecting segment 84 provides a film of lubricant therebetween as well as an area of softness to inhibit shoe lockup if the shoe 100 becomes misaligned. Thus, the elastomeric pads 92, frictions shoes 100 and wedge 110 are inhibited from being stuck in an inward pressed position.

While an embodiment of this invention has been shown and described, it should be understood that the invention is not limited hereto except by the scope of the claims. Various modifications and changes can be made without departing from the scope and spirit of the invention as the same will be understood by those skilled in the art.

What I claim is:

1. A draft gear for a railroad car coupler system, said draft gear comprising:

a cast housing having an inner section to hold a spring package and an outer friction bore section connecting with said inner section, said friction bore section defined by sidewalls set in a hexagon shaped array with inner surfaces of said sidewalls positioned to form a top and two side equispaced friction shoe seats from adjacent pairs of said sidewall inner surfaces and a radiused corner between said adjacent sides, each said friction shoe seat having a grooved recess defined by an inner and outer groove portion joined by a connecting groove portion positioned substantially perpendicular to said inner and outer groove portions with said connecting groove portion of each said recess being in proximate alignment with said corner of said friction shoe seat respectively and said connecting groove portions of said recesses of said side friction shoe seats having walls positioned on an angle to form an enlarged opening into said side friction shoe seat connecting groove portions; and insert means forming a rigid unit disposed in each said friction shoe seat grooved recess to provide a film of lubricant between said surfaces of said friction shoe seats and wear surfaces of friction shoes disposable in said housing outer friction bore section, wherein said friction bore recesses may be cast as part of said housing friction bore section by a mold core from a two-piece core box, and a coefficient of friction between said friction shoes and said friction shoe seats is continuously regulated by said film of lubricant to control frictional restraint to movement of said shoes in said seats.

2. A draft gear as defined by claim 1 and further characterized by, said insert means having a pair of elongated segments and a connecting segment to fit snugly into said inner, outer and connecting groove portions respectively of said grooved recesses with an inner surface of said insert aligning with said friction seat surfaces.

3. A draft gear as defined by claim 2 and further characterized by, said insert elongated segments having a radiused portion to align with said friction shoe seat corner and straight end portions joined thereto to align with said friction shoe seat sidewall inner surfaces.

4. A railroad car coupler system draft gear comprising:

a housing having a hollow cast body divided into an inner section and an outer friction bore section, elastomeric means carried in said inner section, an intermediate follower engaging said elastomeric means and having an outer end extending into said housing friction bore section, a top and a pair of side friction shoe seats each defined by pairs of inner surfaces of sidewalls of said housing friction bore section and corners formed at a joinder of said pairs of said sidewall inner surfaces, a grooved recess formed as part of each said friction shoe seat, said recess having an inner and outer groove portion positioned substantially perpendicular to a longitudinal axis of said housing and a connecting groove portion joining said inner and outer groove portions and positioned in proximate alignment with said seat corner with a lower and upper wall of said connecting groove portion of said side grooved recesses positioned to form an enlarged opening into each said side grooved recess connecting groove portion, an insert having a rigid body of a bronze-like material defined by a pair of elongated segments and a connecting segment joined thereto with one each of said inserts disposed in said friction seat grooved recesses, a set of friction shoes carried one each in said housing friction bore friction shoe seats, said friction shoes having wear surfaces spaced apart by a radiused end with said shoe wear surfaces in contact respectively with said insert elongated segments and said shoe radiused ends positioned to engage said insert connecting segments, and a wedge positioned between said friction shoes with said wedge having sloped wedging surfaces engaging with inside walls of said shoes, wherein said grooved recesses may be formed as said housing is cast by a core prepared in a two-piece core box having core portions mating to align with said top friction shoe seat recess connecting groove portion, and an impacting force on said wedge may move said wedge inward toward an end wall of said housing to force said shoes radially outward and move said shoes inward under a frictional restraint, said restraint being regulated in part by material of said insert acting as a lubricant to control a coefficient of friction between said shoes and said friction shoe seats, said inward shoe movement on occasions being sufficient to uncover said friction shoe seat grooved recess outer groove portions with said insert body maintaining said insert elongated segment in said outer groove portion to insure continued control of said frictional restraint.

5. A draft gear as defined by claim 4 and further characterized by, said insert elongated segments having a crescent-like shape.

6. A draft gear as defined by claim 5 and further characterized by, said insert elongated segments defined by a middle radiused portion joined by straight end portions with said connecting segment joined to said elongated segments at said middle radiused portion.

7. A draft gear as defined by claim 6 and further characterized by, an inner surface of said insert segments being substantially flat with an outer surface of such being radiused.

* * * * *